US011920289B2

(12) United States Patent
Wu et al.

(10) Patent No.: US 11,920,289 B2
(45) Date of Patent: Mar. 5, 2024

(54) TEMPERATURE CONTROL METHOD FOR CLOTHES DRYING TREATMENT DEVICE, AND CLOTHES DRYING TREATMENT DEVICE

(71) Applicants: QINGDAO HAIER LAUNDRY ELECTRIC APPLIANCES CO., LTD., Shandong (CN); HAIER SMART HOME CO., LTD., Shandong (CN)

(72) Inventors: Jun Wu, Shandong (CN); Wenwei Li, Shandong (CN); Guanghui Pan, Shandong (CN); Yubao Wang, Shandong (CN); Guangfeng Wang, Shandong (CN)

(73) Assignees: QINGDAO HAIER LAUNDRY ELECTRIC APPLIANCES CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 361 days.

(21) Appl. No.: 17/052,993

(22) PCT Filed: Apr. 30, 2019

(86) PCT No.: PCT/CN2019/085120
§ 371 (c)(1),
(2) Date: Nov. 4, 2020

(87) PCT Pub. No.: WO2019/210842
PCT Pub. Date: Nov. 7, 2019

(65) Prior Publication Data

US 2021/0123183 A1 Apr. 29, 2021

(30) Foreign Application Priority Data

May 4, 2018 (CN) ..... 201810420050.3

(51) Int. Cl.
*F26B 19/00* (2006.01)
*D06F 58/38* (2020.01)
(Continued)

(52) U.S. Cl.
CPC ..... *D06F 58/38* (2020.02); *D06F 2101/06* (2020.02); *D06F 2103/06* (2020.02);
(Continued)

(58) Field of Classification Search
CPC .. D06F 58/38; D06F 2101/06; D06F 2103/06; D06F 2103/12; D06F 2103/52; D06F 2105/28
(Continued)

(56) References Cited

U.S. PATENT DOCUMENTS 3,942,265 A 3/1976 Sisler et al.
4,763,425 A * 8/1988 Grennan ..... D06F 58/38 34/552
(Continued)

FOREIGN PATENT DOCUMENTS

CN 1460141 A 12/2003
CN 104631069 A 5/2015
(Continued)

OTHER PUBLICATIONS

Office Action issued in CN Application No. 201810420050; dated Apr. 22, 2021. 12 Pages (with Translation).
(Continued)

*Primary Examiner* — John P McCormack
(74) *Attorney, Agent, or Firm* — BUCHANAN INGERSOLL ROONEY PC

(57) ABSTRACT

A heating device of a clothes drying treatment device executes an on or off operation in a temperature interval. When the temperature in a drum reaches an upper limit value TDx of the temperature interval under an action of the
(Continued)

heating device, the heating device is turned off and the heating device stops heating. The upper limit value TDx decreases as a number of off times x of the heating device increases. Accordingly, a higher initial off temperature is adopted for the heating device, the temperature in the drum rapidly increases to the drying temperature, a preheating time is shortened, and a certain coefficient is multiplied in following control parameters controlling on or off of the heating device. The coefficient is related to the number of on-off times, and the effect is achieved that the off temperature of the clothes dryer gradually decreases as the number of on-off times increases.

9 Claims, 2 Drawing Sheets

(51) Int. Cl.

| | |
|---|---|
| *D06F 101/06* | (2020.01) |
| *D06F 103/06* | (2020.01) |
| *D06F 103/12* | (2020.01) |
| *D06F 103/32* | (2020.01) |
| *D06F 103/52* | (2020.01) |
| *D06F 105/28* | (2020.01) |

(52) U.S. Cl.
CPC ..... *D06F 2103/12* (2020.02); *D06F 2103/32* (2020.02); *D06F 2103/52* (2020.02); *D06F 2105/28* (2020.02)

(58) Field of Classification Search
USPC ..... 34/553, 497, 496, 493, 498
See application file for complete search history.

(56) References Cited

U.S. PATENT DOCUMENTS

| | | | | |
|---|---|---|---|---|
| 4,827,627 | A * | 5/1989 | Cardoso | D06F 58/38 34/526 |
| 5,161,314 | A * | 11/1992 | Souza | D06F 58/44 34/493 |
| 5,555,641 | A | 9/1996 | Lee | |
| 6,079,121 | A * | 6/2000 | Khadkikar | D06F 34/26 34/531 |
| 6,924,466 | B2 | 8/2005 | Lee | |
| 9,487,910 | B2 | 11/2016 | Huang et al. | |
| 10,184,208 | B2 | 1/2019 | Rizzi et al. | |
| 2004/0060196 | A1* | 4/2004 | Lueckenbach | D06F 58/38 34/595 |
| 2004/0060197 | A1* | 4/2004 | Jeong | D06F 34/18 34/595 |
| 2015/0059200 | A1* | 3/2015 | Prajescu | D06F 58/38 34/524 |

FOREIGN PATENT DOCUMENTS

| | | | |
|---|---|---|---|
| CN | 106012411 | A | 10/2016 |
| CN | 106661816 | A | 5/2017 |
| CN | 107663761 | A | 2/2018 |
| DE | 102006051505 | A1 | 5/2008 |
| DE | 102007046069 | B4 | 6/2018 |
| EP | 2977503 | A1 | 1/2016 |
| JP | H06218199 | A | 8/1994 |
| KR | 20050069371 | A | 7/2005 |

OTHER PUBLICATIONS

European Search Opinion issued in EP Application No. 19797139; dated May 28, 2021; 2 pages.
International Search Report (with English Translation) and Written Opinion issued in corresponding International Patent Application No. PCT/CN2019/085120, 11 pages (dated Jul. 29, 2019).

* cited by examiner

TEMPERATURE CONTROL METHOD FOR CLOTHES DRYING TREATMENT DEVICE, AND CLOTHES DRYING TREATMENT DEVICE

TECHNICAL FIELD

The present disclosure belongs to the field of clothes dryer devices, and in particular relates to a temperature control method for a clothes drying treatment device and a clothes drying treatment device.

BACKGROUND

A clothes dryer is one of the indispensable appliances in daily life. It is a cleaning household appliance using electric heating for instant evaporative drying of the moisture in washed clothes. This is particularly desirable for the cases where clothes are difficult to dry in the northern winter and southern "damp season". Additionally, clothes dryers are used in large quantities in industrial production for drying fabrics, increasing production efficiency.

In order to allow the clothes in the clothes dryer to be heated at a suitable temperature, it is common to provide a temperature on/off interval where the heating device is turned off when the temperature in clothes dryer is higher than the highest temperature of the interval, and when the heating device is turned on to continue heating when the temperature in clothes dryer is lower than the lowest temperature of the interval, but there are great drawbacks to this temperature control method. As a matter of experience, during the drying process, silk fabrics will deform and protein denatured when the temperature in clothes dryer exceeds 45° C., while chemical fiber fabrics will shrink and deform when the temperature exceeds 60° C. In many cases, functional garments such as sportswear and mountain climbing sportswear are made of materials that are permeable and waterproof materials or stretchy materials. Functional garments that have undergone washing may lose their cloth-specific properties, such as waterproofing properties. If the functional garments that lose their function are dried at a temperature unsuitable for their materials, the lost function is not restored or the garments deform. Therefore, during drying of special clothes made of silk, chemical fibers, and the like, the drying temperature needs to be controlled to prevent deformation of the clothes due to excessive temperature, and a sufficient drying temperature needs to be guaranteed. When a fixed on-off temperature control is adopted, if the upper temperature limit is set too high, damage to the clothes is likely to occur, and if the upper temperature limit is set too low, the rate of increase of the temperature in the dryer drum is severely affected, thereby increasing the drying time.

In view of this, the present disclosure is particularly proposed.

SUMMARY

The technical problem to be solved by the present disclosure is to overcome the deficiencies of the prior art, providing a temperature control method for a clothes drying treatment device and providing a clothes drying treatment device. A higher initial off temperature is adopted for a heating device of the clothes drying treatment device, the temperature in the drum rapidly increases to the drying temperature of the clothes drying treatment device, a preheating time of the clothes drying treatment device is shortened. A certain coefficient is multiplied by in the following control parameters controlling on/off of the heating device, the coefficient is related to the number of on-off times, the effect is achieved that the off temperature of the heating device gradually decreases as the number of on-off times increases, and the on temperature is adjusted accordingly as the number of the on times of the heating device, and the contradiction between a high temperature required by a clothes dryer initially and a low temperature required in the later drying process is effectively balanced.

In order to achieve the objective, the present disclosure adopts the following technical solutions.

A temperature control method for a clothes drying treatment device is disclosed. A heating device of the clothes drying treatment device executes an on/off operation in a temperature interval. When a temperature in the clothes drying treatment device reaches an upper limit value TDx of the temperature interval under the action of the heating device, the clothes drying treatment device turns off the heating device and the heating device stops heating. The upper limit value TDx of the temperature interval decreases as a number of an off times x of the heating device increases.

Further, the clothes drying treatment device has a system off temperature TD0, TD0 is a set value, and TDx is infinitely close to TD0 as the number of the off times x of the heating device increases.

Preferably, TD0 is determined by clothes materials in the clothes drying treatment device, each clothes material has a highest heating temperature that can be withstood during drying respectively. TD0 is less than a minimum temperature among the highest heating temperatures that can be withstood corresponding to all clothes materials in the clothes drying treatment device.

Preferably, the highest heating temperature that clothes made of silk can be withstood is 45° C. and the highest heating temperature that clothes made of polyester can be withstood is 60° C.

Further, the clothes drying treatment device has an off constant A and a highest value TDS of the upper limit value of the temperature interval. The upper limit value TDx of the temperature interval is not greater than TDS, and TDS=TD0+A, where A is a set value greater than 0.

Preferably, the highest value TDS of the upper limit value of the temperature interval is determined by clothes materials in the clothes drying treatment device, each clothes material has a highest heating temperature that can be withstood during drying. TDS is a minimum temperature among the highest heating temperatures that can be withstood corresponding to all clothes materials in the clothes drying treatment device.

Preferably, 0<A<TD0.

Further, the clothes drying treatment device turns off the heating device when the temperature in a drum increases to the upper limit value TDx of the temperature interval at an xth time under the heating action of the heating device. TDx and x satisfy TDx=TD0+A*K^(x−1), where 0<K<1, where K is a parameter coefficient.

Further, the heating device of the clothes drying treatment device executes on/off operation in the temperature interval. When the temperature in the drum decreases to a lower limit value TTy of the temperature interval at a yth time, the clothes drying treatment device turns on the heating device and the heating device executes heating. The lower limit value TTy of the temperature interval increases as a number of an on times y of the heating device increases.

Further, the clothes drying treatment device has a system on temperature TT0, TT0 is a set value. And TTy is infinitely close to TT0 as the number of the on times y of the heating device increases.

Preferably, TT0 is determined by the liquid point temperature of the liquid in clothes in the clothes drying treatment device, and TT0 is greater than the liquid point temperature.

Further, the clothes drying treatment device has an on constant B and a lowest value TTS of the lower limit value of the temperature interval. The lower limit value TTy of the temperature interval is not less than TTS, and TTS=TT0−B, where B is a set value greater than 0.

Preferably, the lowest value TTS of the lower limit value of the temperature interval is determined by the liquid point temperature of the liquid in clothes in the clothes drying treatment device, and TTS is the liquid point temperature.

Preferably, 0<B<TT0.

Further, the clothes drying treatment device turns on the heating device when the temperature in the drum decreases to the lower limit value TTy of the temperature interval at the yth time after the heating device stops heating. TTy and y satisfy: TTy=TT0-B*M^(y−1), where 0<M<1, where M is a parameter coefficient.

Further, the heating device of the clothes drying treatment device executes on/off operation in the temperature interval. When the temperature in the drum decreases to a lower limit value of the temperature interval TTz at a zth time, the clothes drying treatment device turns on the heating device and the heating device executes heating. The lower limit value of the temperature interval TTz decreases as a number of an on times z of the heating device increases.

Preferably, the clothes drying treatment device has a system on temperature TT0, TT0 is a set value. And TTz is infinitely close to TT0 as the number of the on times z of the heating device increases.

Preferably, TT0 is determined by the liquid point temperature of the liquid in clothes in the clothes drying treatment device, and TT0 is greater than the liquid point temperature.

Preferably, the clothes drying treatment device has an on constant C and a highest value TTS of the lower limit value of the temperature interval. The lower limit value TTz of the temperature interval is not greater than TTS, and TTS=TT0+C, where C is a set value greater than 0.

Preferably, the highest value TTS of the lower limit value of the temperature interval is determined by the liquid point temperature of the liquid in clothes in the clothes drying treatment device, and TTS is the liquid point temperature.

Preferably, 0<C<TT0.

Preferably, the clothes drying treatment device turns on the heating device when the temperature in the drum decreases to the lower limit value of the temperature interval TTz at a zth time after the heating device stops heating. TTz and z satisfy: TTz=TT0+C*N^(z−1), where 0<N<1, where N is a parameter coefficient.

A clothes drying treatment device using the temperature control method for the clothes drying treatment device according to any of the above, is provided with a heating device, a temperature measuring device and a control device electrically connected to each other.

The heating device is configured to heat the clothes drying treatment device for drying clothes.

The temperature measuring device is configured to measure the temperature of the clothes drying treatment device and transmit the temperature information measured to the control device.

The control device receives the temperature information and controls the heating device to perform on/off operation in the temperature interval according to the temperature information.

With the above technical solution, the present disclosure has the following advantageous effects over the prior art.

According to the temperature control method for the clothes drying treatment device and the clothes drying treatment device of the present disclosure, a higher initial off temperature is adopted for the heating device. The temperature in the drum rapidly increases to the drying temperature of the clothes drying treatment device, a preheating time of the clothes drying treatment device is shorten. And a certain coefficient is multiplied by in the following control parameters controlling on or off of the heating device, the coefficient is related to the number of on-off times, and the effect is achieved that the off temperature of the clothes drying treatment device gradually decreases as the number of on-off times increases.

The on temperature is adjusted accordingly as the number of the on times of the heating device; heat absorbed by the clothes in the drum can be effectively released. It is guaranteed that during drying, especially in the later drying process a continuous low-temperature balance can be realized. And there is no obvious rise of the temperature in the clothes drying treatment device, so that the temperature balance in the drum is maintained. Not only is damage to clothes avoided, but also the drying time is guaranteed, and the contradiction between an initial temperature rise of a clothes dryer and a later temperature control is effectively balanced.

At the same time, since in the drying process, the heat absorbed by the clothes is sufficiently released and utilized, the heating time of the heating device is substantially reduced, thereby reducing electric power consumption of the clothes drying treatment device, which is beneficial for environmental protection and energy saving of the clothes drying treatment device. In addition, in the drying process the temperature is stable, and the low-temperature drying process is realized, so that the cases of wrinkles and deformation during the drying process of the clothes are reduced, the dry clothes are made even more flat, and the work burden of the user for ironing is reduced.

Specific embodiments of the present disclosure are described in further detail below with reference to the accompanying drawings.

BRIEF DESCRIPTION OF THE DRAWINGS

The drawings serving as one part of the present disclosure are intended to provide a further understanding for the present disclosure. Schematic embodiments and illustrations of the present disclosure are intended to explain the present disclosure, rather than an improper limitation of the present disclosure. Apparently, the accompanying drawings in the description below are merely some of the embodiments of the present disclosure. Other drawings may be obtained by those ordinary skilled in the art without making creative labor in accordance with these drawings. In the drawings.

It should be indicated that, these accompanying drawings and textual descriptions are intended not to limit the concept scope of the present disclosure in any manner, but to explain the concept of the present disclosure to those skilled in the art with reference to specific embodiments.

DETAILED DESCRIPTION

To make the objectives, technical solutions and advantages of the embodiments of the present disclosure clearer, a clear and complete description of the technical solutions in the embodiments will be proposed below, in combination with the accompanying drawings in the embodiments of the present disclosure. Embodiments described herein are only adopted to explain the present disclosure, rather than a limitation of the scope of the present disclosure.

It should be understood in the description of the present disclosure that, terms such as "upper", "lower", "front", "rear", "left", "right", "vertical", "inner", "outer", etc. indicate direction or position relationships shown based on the drawings, and are only intended to facilitate the description of the present disclosure and simplify the description rather than to indicate or imply that the indicated device or element must have a specific direction or constructed and operated in a specific direction, and therefore, shall not be understood as a limitation to the present disclosure.

In the present disclosure, it should be noted that, unless otherwise specifically regulated and defined, terms such as "installation", "connected", "connecting" and the like shall be understood in broad sense, and for example, may refer to fixed connection or detachable connection or integral connection, may refer to mechanical connection or electrical connection, and may refer to direct connection or indirect connection through an intermediate medium. For those ordinary skilled in the art, the specific meanings of the above terms in the present disclosure may be understood according to concrete conditions.

Figure 2:
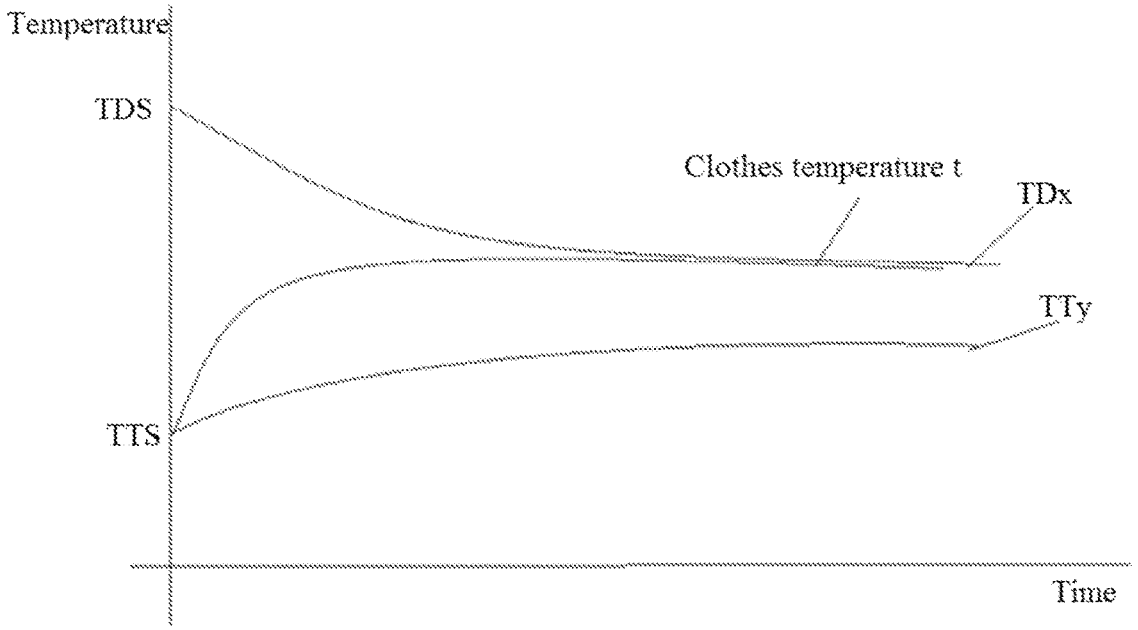
FIG. 2 is a graph of temperature trend in a clothes drying treatment device of Embodiment 1 of a temperature control method for a clothes drying treatment device of the present disclosure.
Figure 3:
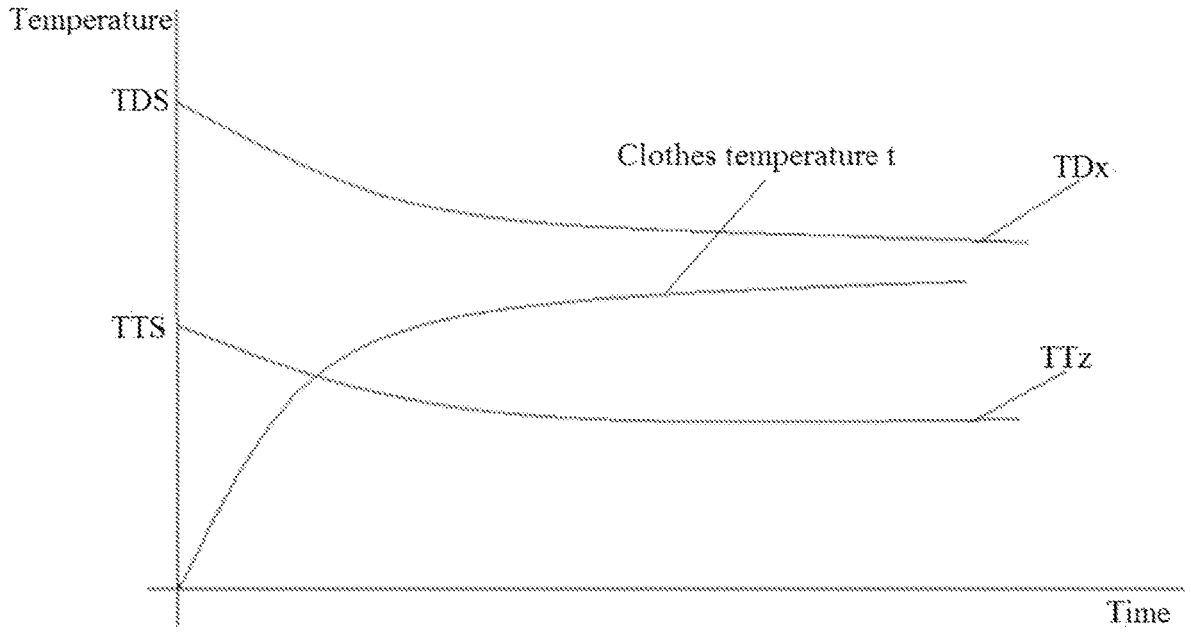
FIG. 3 is a graph of temperature trend in a clothes drying treatment device of Embodiment 2 of a temperature control method for a clothes drying treatment device of the present disclosure.

As shown in FIGS. 2 and 3, the present disclosure discloses a temperature control method for a clothes drying treatment device and a clothes drying treatment device. A heating device of the clothes drying treatment device executes an on or off operation in a temperature interval, when the temperature in a drum reaches an upper limit value TDx of the temperature interval under the heating action of the heating device, the clothes drying treatment device turns off the heating device and the heating device stops heating. The upper limit value TDx of the temperature interval decreases as a number of the off times x of the heating device increases. In the present disclosure, a higher initial off temperature is adopted for the heating device of the clothes drying treatment device, the temperature in the drum rapidly increases to the drying temperature of the clothes drying treatment device, a preheating time of the clothes drying treatment device is shorten. And a certain coefficient is multiplied by in the following control parameters controlling on/off of the heating device, the coefficient is related to the number of on-off times, the effect is achieved that the off temperature of the heating device gradually decreases as the number of on-off times increases, and the on temperature is adjusted accordingly as the number of the on times of the heating device. In this way, the contradiction between a high temperature required by a clothes dryer initially and a low temperature required in the later drying process is effectively balanced.

Embodiment 1

As shown in FIG. 2, the temperature control method for the clothes drying treatment device is disclosed in this embodiment. The clothes drying treatment device in this embodiment is clothes dryer. The clothes drying treatment device is provided with a heating device, a temperature measuring device, and a control device electrically connected to each other. The heating device is configured to heat the clothes drying treatment device to increase the temperature in the clothes drying treatment device and to accelerate the vaporization process of the liquid on surfaces of clothes so as to dry the clothes. At the same time, the temperature measuring device is provided in the clothes drying treatment device. The temperature measuring device is configured to measure the temperature information of the clothes drying treatment device and transmit the measured temperature information to the control device. The control device receives the temperature information and controls the heating device to perform the on or off operation in a temperature interval according to the temperature information.

Figure 1:
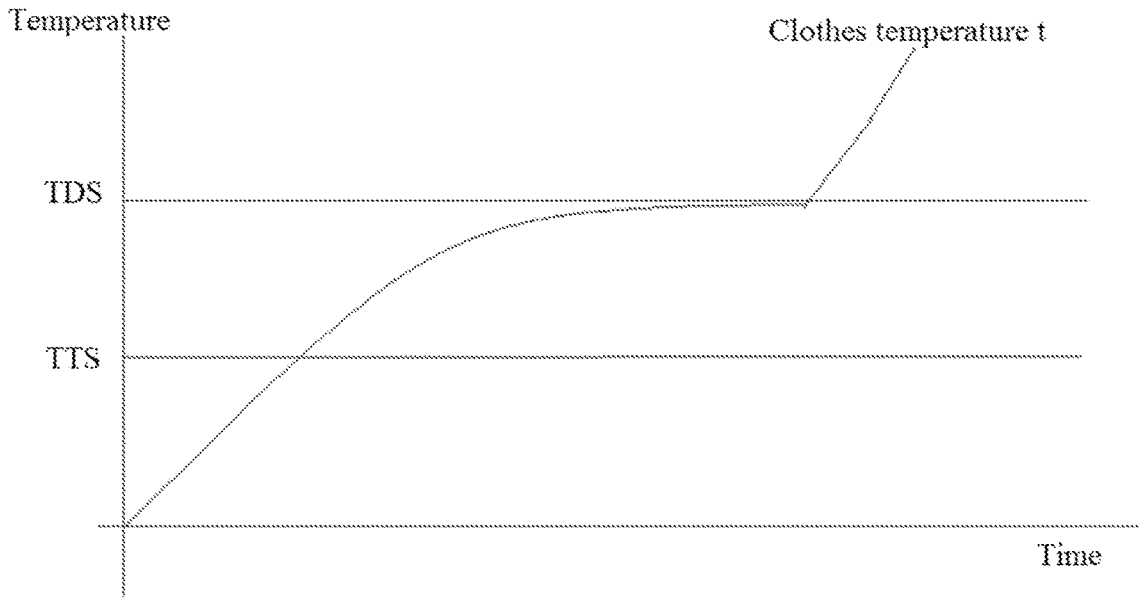
FIG. 1 is a graph of temperature trend in a clothes drying treatment device of the existing temperature control method for a clothes drying treatment device.

The clothes drying temperature control of the existing clothes drying treatment device is in the manner shown in FIG. 1, i.e., the clothes drying treatment device has the highest value TDS of the upper limit value of the temperature interval and the lowest value TTS of the lower limit value of the temperature interval. In an initial heating stage of the clothes drying treatment device, the heating device is controlled to be operating to continuously increase the temperature in the clothes drying treatment device. When the temperature reaches the highest value TDS of the upper limit value of the temperature interval, the heating device is turned off to stop heating the clothes drying treatment device. And when the temperature in the clothes drying treatment device continues to decrease to the lowest value TTS of the lower limit value of the temperature interval, the heating device is turned on again, so that the temperature in the clothes drying treatment device continues to increase. The above operations are carried out circularly until the clothes are dried. The temperature at which the heating device is controlled to perform the on/off operation transition in the current control method is a constant value, that is, the on/off control temperature interval of the heating device is composed of two parallel temperature control lines one above the other, as shown in FIG. 1, and this temperature control presents a big problem.

As shown in FIG. 1, under the above control method of the clothes drying treatment device, the temperature of the clothes in the drum will continue to increase at a later stage of drying process and be infinitely close to TDS. In the current control method, the determination of TDS is a technical difficulty; this is because firstly TDS cannot be set too high. While ensuring a reduction in the drying time with high TDS, it may damage the clothes. And even if TDS is set below the highest temperature that the clothes can withstand, this too high drying temperature is a huge waste of energy in the later stage of drying process. This is because in the earlier stage of drying process, the moisture in the clothes has been already sufficiently vaporized, so that in the later stage of drying process, the efficiency of drying is no longer dependent on a higher heating temperature, but rather relies on the rapid discharge of moisture as possible. Maintaining a higher drying temperature in the later stage of drying process not only requires a continuously higher power supply, but does not improve the drying effect. A too high drying temperature is also prone to excessive wrinkles of clothes, and a user needs a further ironing step to the clothes, bringing inconvenience to the user.

On the other hand, if TDS is set to be lowered, the clothes dryer is operated at a lower temperature, this way of drying increases the preheating time of the clothes drying device, and increases the time for moisture vaporization, thereby substantially increasing the overall drying time, so that the clothes stay too long in the clothes dryer and are prone to secondary contamination.

In view of this, the present disclosure proposes a new drying temperature control method for the clothes drying treatment device.

In the present disclosure, a heating device of the clothes drying treatment device executes an on/off operation in a temperature interval, as shown in FIG. 2. In this embodiment, when the temperature in the drum reaches the upper limit value TDx of the temperature interval under the action of the heating device, the clothes drying treatment device turns off the heating device and the heating device stops heating; the upper limit value TDx of the temperature interval decreases as the number of the off times x of the heating device increases. That is, the upper temperature limit at which the heating device is controlled to be turned off is no longer a constant value, but a variable value that is related to the number of the off times x of the heating device, and decreases as x increases.

The clothes drying treatment device of this embodiment has a system off temperature TD0, TD0 is a set value, and TDx is infinitely close to TD0 as the number of the off times x of the heating device increases. TD0 is determined by the clothes materials in the clothes drying treatment device, each clothes material has a highest heating temperature that can be withstood during drying respectively. TD0 is less than a minimum temperature among the highest heating temperatures that can be withstood corresponding to all clothes materials in the clothes drying treatment device.

Preferably, the highest heating temperature that clothes made of silk can be withstood is 45° C. and the highest heating temperature that clothes made of chemical fibers can be withstood is 60° C.

The clothes drying treatment device of this embodiment has an off constant A and the highest value TDS of the upper limit value of the temperature interval. The upper limit value TDx of the temperature interval is not greater than TDS, and TDS=TD0+A. Where A is a set value greater than 0; and the constant A is used to adjust the magnitude of the amplitude of two adjacent off temperatures.

The highest value TDS of the upper limit value of the temperature interval is determined by the clothes materials in the clothes drying treatment device. Each clothes material corresponds to a highest heating temperature that can be withstood during drying respectively. TDS is a minimum temperature among the highest heating temperatures that can be withstood corresponding to all clothes materials in the clothes drying treatment device. Preferably, 0<A<TD0.

Further, the clothes drying treatment device turns off the heating device when the temperature in the drum of the clothes drying treatment device increases to the upper limit value TDx of the temperature interval at an xth time under the heating action of the heating device, TDx and x satisfy: TDx=TD0+A*K^(x−1), where 0<K<1.

The temperature control method for the clothes drying treatment device of this embodiment is advantageous compared to the existing clothes drying temperature control method in that since the upper limit value TDx of the temperature interval gradually decreases as x increases so that the heat subsequently entering the clothes drying treatment device gradually decreases, the clothes temperature t does not exceed TDS. TDS may be set as the highest temperature that the clothes can withstand, such that not only is the preheating requirement for initial drying met, but also the effect that the clothes temperature t does not exceed the highest limit can be achieved. The requirement to achieve a gradual decrease of the off temperature, thereby maintaining a balance of the temperature in the drum, is met.

Similar to TDx, in this embodiment, when the temperature in the drum of the clothes drying treatment device decreases to the lower limit value TTy of the temperature interval at a yth time, the clothes drying treatment device turns on the heating device and the heating device executes heating. The lower limit value TTy of the temperature interval increases as the number of the on times y of the heating device increases.

The clothes drying treatment device of this embodiment has a system on temperature TT0, TT0 is a set value, and TTy is infinitely close to TT0 as the number of the on times y of the heating device increases. TT0 is determined by the liquid point temperature of the liquid on the clothes in the clothes drying treatment device, and TT0 is greater than the liquid point temperature.

The clothes drying treatment device of this embodiment has an on constant B and the lowest value TTS of the lower limit value of the temperature interval, the lower limit value TTy of the temperature interval is not less than TTS, and TTS=TT0−B. Where B is a set value greater than 0; and the constant B is used to adjust the magnitude of the amplitude of two adjacent on temperatures.

The lowest value TTS of the lower limit value of the temperature interval is determined by the liquid point temperature of the liquid on the clothes in the clothes drying treatment device, and TTS is the liquid point temperature. Preferably, 0<B<TT0.

Further, the clothes drying treatment device turns on the heating device when the temperature in the drum decreases to the lower limit value TTy of the temperature interval at a yth time after the heating device stops heating, TTy and y satisfy: TTy=TT0−B*M^(y−1), where 0<M<1. The lower limit value TTy of the temperature interval of this embodiment increases as the number of the on times y of the heating device increases. The clothes drying treatment device system is allowed to increase the temperature in the clothes drying treatment device as much as possible, increase the clothes drying speed, reduce the clothes drying time, and apply in a case where rapid drying is required, provided that the clothes temperature t is not higher than TDS. Such setting fulfills the requirement that a higher temperature in the drum is required during the initial drying stage and a lower drying temperature is required during the later drying stage.

Embodiment 2

As shown in FIG. 3, this embodiment is supplementary to Embodiment 1. The difference between this embodiment and Embodiment 1 is that when the temperature in the drum decreases to the lower limit value of the temperature interval TTz at a zth time, the clothes drying treatment device turns on the heating device and the heating device executes heating. The lower limit value of the temperature interval TTz decreases as the number of the on times z of the heating device increases. The clothes drying treatment device has a system on temperature TT0, TT0 is a set value, and TTz is infinitely close to TT0 as the number of the on times z of the heating device increases. TT0 is determined by the liquid point temperature of the liquid on the clothes in the clothes drying treatment device, and TT0 is greater than the liquid point temperature.

The clothes drying treatment device of this embodiment has an on constant C and the lowest value TTS of a lower limit value of the temperature interval, the lower limit value TTy of the temperature interval is not greater than TTS, and TTS=TT0+C, C is a set value greater than 0; and the constant C is used to adjust the magnitude of the amplitude of two adjacent on temperatures.

The lowest value TTS of the lower limit value of the temperature interval is determined by the liquid point temperature of the liquid in clothes in the clothes drying treatment device, and TTS is the liquid point temperature. Preferably, 0<C<TT0.

Further, the clothes drying treatment device turns on the heating device when the temperature in the drum decreases to the lower limit value of the temperature interval TTz at a zth time after the heating device stops heating, TTz and z satisfy: TTz=TT0+C*N^(z−1), where 0<N<1. The lower limit value TTy of the temperature interval of this embodiment decreases as the number of the on times y of the heating device increases. The clothes drying treatment device is allowed to perform a drying operation at a lower clothes temperature t, which is suitable for use in a drying case where a lower drying temperature needs to be guaranteed and there is no severe requirement for drying time for special materials such as outdoor jackets or clothes made of silk.

Embodiment 3

A clothes drying treatment device adopts the temperature control method for the clothes drying treatment device as described in any of the above embodiments, which is provided with a heating device, a temperature measuring device, and a control device electrically connected to each other. The heating device is configured to heat the clothes drying treatment device for drying clothes. The temperature measuring device is configured to measure the temperature information of the clothes drying treatment device and transmit the measured temperature information to the control device. The control device receives the temperature information and controls the heating device to perform an on/off operation in the temperature interval according to the temperature information.

In this embodiment, when the temperature in the drum reaches the upper limit value TDx of the temperature interval under the action of the heating device, the clothes drying treatment device turns off the heating device and the heating device stops heating. The upper limit value TDx of the temperature interval decreases as the number of the off times x of the heating device increases. That is, the upper temperature limit at which the heating device is controlled to be turned off is no longer a constant value, but a variable value that is related to the number of the off times x of the heating device, and decreases as x increases.

The clothes drying treatment device of this embodiment has a system off temperature TD0, TD0 is a set value, and TDx is infinitely close to TD0 as the number of the off times x of the heating device increases. TD0 is determined by the clothes materials in the clothes drying treatment device. Each clothes material corresponds to a highest heating temperature that can be withstood during drying respectively; and TD0 is less than a minimum temperature among the highest heating temperatures that can be withstood corresponding to all clothes materials in the clothes drying treatment device.

Preferably, the highest heating temperature that clothes made of silk can withstand is 45° C. and the highest heating temperature that clothes made of chemical fibers can withstand is 60° C.

The clothes drying treatment device of this embodiment has an off constant A and the highest value TDS of the upper limit value of the temperature interval. The upper limit value TDx of the temperature interval is not greater than TDS, and TDS=TD0+A. Where A is a set value greater than 0; and the constant A is used to adjust the magnitude of the amplitude of two adjacent off temperatures.

The highest value TDS of the upper limit value of the temperature interval is determined by the clothes materials in the clothes drying treatment device, each clothes material corresponds to a respective highest heating temperature that can be withstood during drying. TDS is the minimum temperature among the highest heating temperatures that can be withstood corresponding to all clothes materials in the clothes drying treatment device. Preferably, 0<A<TD0.

Further, the clothes drying treatment device turns off the heating device when the temperature in the drum of the clothes drying treatment device increases to the upper limit value TDx of the temperature interval at an xth time under the heating action of the heating device, TDx and x satisfy TDx=TD0+A*K^(x−1), where 0<K<1. The temperature control method for the clothes drying treatment device of this embodiment is advantageous compared to the existing clothes drying temperature control method in that since the upper limit value TDx of the temperature interval gradually decreases as x increases so that the heat subsequently entering the clothes drying treatment device gradually decreases, the clothes temperature t does not exceed TDS. TDS may be set as the highest temperature that the clothes can withstand, such that not only is the preheating requirement for initial drying met, but also the effect that the clothes temperature t does not exceed the highest limit can be achieved. The requirement to achieve a gradual decrease of the off temperature, thereby maintaining a balance of the temperature in the drum, is met.

Similar to TDx, in this embodiment, when the temperature in the drum of the clothes drying treatment device decreases to the lower limit value TTy of the temperature interval at a yth time, the clothes drying treatment device turns on the heating device and the heating device executes heating. And the lower limit value TTy of the temperature interval increases as the number of the on times y of the heating device increases.

The clothes drying treatment device of this embodiment has a system on temperature TT0, TT0 is a set value, and TTy is infinitely close to TT0 as the number of the on times y of the heating device increases. TT0 is determined by the liquid point temperature of the liquid on the clothes in the clothes drying treatment device, and TT0 is greater than the liquid point temperature.

The clothes drying treatment device of this embodiment has an on constant B and the lowest value TTS of a lower limit value of the temperature interval, the lower limit value TTy of the temperature interval is not less than TTS, and TTS=TT0−B. Where B is a set value greater than 0; and the constant B is used to adjust the magnitude of the amplitude of two adjacent on temperatures.

The lowest value TTS of the lower limit value of the temperature interval is determined by the liquid point temperature of the liquid on the clothes in the clothes drying treatment device, and TTS is the liquid point temperature. Preferably, 0<B<TT0.

Further, the clothes drying treatment device turns on the heating device when the temperature in the drum decreases to the lower limit value TTy of the temperature interval at a yth time after the heating device stops heating, TTy and y satisfy: TTy=TT0−B*MA(y−1), where 0<M<1. The lower limit value TTy of the temperature interval of this embodiment increases as the number of the on times y of the heating device increases. The clothes drying treatment device system is allowed to increase the temperature in the clothes drying treatment device as much as possible, increase the clothes drying speed, reduce the clothes drying time, and apply in a case where rapid drying is required, provided that the clothes drying temperature t is not higher than TDS.

Alternatively, when the temperature in the drum decreases to the lower limit value of the temperature interval TTz at a zth time, the clothes drying treatment device turns on the heating device and the heating device executes heating. The lower limit value of the temperature interval TTz decreases as the number of the on times z of the heating device increases. The clothes drying treatment device has a system on temperature TT0, TT0 is a set value, and TTz is infinitely close to TT0 as the number of the on times z of the heating device increases. TT0 is determined by the liquid point temperature of the liquid on the clothes in the clothes drying treatment device, and TT0 is greater than the liquid point temperature. The clothes drying treatment device has an on constant C and the highest value TTS of a lower limit value of the temperature interval, the lower limit value of the temperature interval is not greater than TTS, and TTS=TT0+C. Where C is a set value greater than 0; and the constant C is used to adjust the magnitude of the amplitude of two adjacent on temperatures. The highest value TTS of the lower limit value of the temperature interval is determined by the liquid point temperature of the liquid on the clothes in the clothes drying treatment device, and TTS is the liquid point temperature. Preferably, 0<C<TT0. Further, the clothes drying treatment device turns on the heating device when the temperature in the drum decreases to the lower limit value of the temperature interval TTz at a zth time after the heating device stops heating, TTz and z satisfy: TTz=TT0+C*N^(z−1), where 0<N<1. The lower limit value TTz of the temperature interval decreases as the number of the on times z of the heating device increases. The clothes drying treatment device is allowed to perform a drying operation at a lower clothes temperature t, which is suitable for use in a drying case where a lower drying temperature needs to be guaranteed and there is no severe requirement for drying time for special materials such as outdoor jackets or clothes made of silk.

The control device of the clothes drying treatment device may be configured to control the on/off of the heating device using the rapid drying method as described in Embodiment 1, or may be configured to control the on/off of the heating device using the low temperature drying method as described in Embodiment 2, and therefore, different clothes drying treatment devices may be designed. It is also possible to integrate both of the drying methods on the same clothes drying treatment device, which are selected by a user to enable the clothes drying treatment device to perform the drying operation depending on the clothes drying needs.

It is to be added that the temperature measuring device in this embodiment measures data characterizing the temperature in the clothes drying treatment device. That is to say that the temperature measuring device is a measuring device mounted at a set position for measuring temperature information. The set position may be in the clothes drying treatment device for directly measuring the temperature in the clothes drying treatment device. And it is also possible to place the measuring device outside the clothes drying treatment device to measure at an external location associated with the change in temperature in the clothes drying treatment device, so that the change in temperature in the clothes drying treatment device is indirectly expressed by the relation of the temperature value at the location and the change in data of the temperature in the clothes drying treatment device.

The above are only the preferred embodiments of the present disclosure, and do not limit the present disclosure in any form. Although the present disclosure has been disclosed as the preferred embodiments, it is not intended to limit the present disclosure. Any person skilled in the art familiar with this patent can use the technical content suggested above to make slight changes or modification into equivalent embodiments with equivalent changes without departing from the scope of the technical solution of the present disclosure, but any simple modifications, equivalent changes and modifications made to the above embodiments, that do not depart from the technical solution of the present disclosure, based on the technical essence of the present disclosure still fall within the scope of the present disclosure.

The invention claimed is:

1. A temperature control method for a clothes drying treatment device, comprising a heating device of the clothes drying treatment device executing an on or off operation in a temperature interval, when a temperature in the clothes drying treatment device reaches an upper limit value TDx of the temperature interval under an action of the heating device, the clothes drying treatment device turns off the heating device and the heating device stops heating; wherein, the upper limit value TDx of the temperature interval decreases with an increase of a number of off times x of the heating device;

the heating device of the clothes drying treatment device executes on/off operation in the temperature interval, when the temperature in the clothes drying treatment device decreases to a lower limit value TTy of the temperature interval at a yth time, the clothes drying treatment device turns on the heating device and the heating device executes heating; and the lower limit value TTy of the temperature interval increases with the increase of a number of on times y of the heating device.

2. The temperature control method for the clothes drying treatment device according to claim 1, wherein the clothes drying treatment device is provided with a system off temperature TD0, the system off temperature TD0 is a set value, and the upper limit value TDx is continuously closer to the system off temperature TD0 with the increase of the number of off times x of the heating device;

the system off temperature TD0 is determined by clothes materials in the clothes drying treatment device, each of the clothes materials has a highest heating temperature that can be tolerated during a drying process respectively; the system off temperature TD0 is less than a minimum temperature among highest heating temperatures that can be tolerated corresponding to the clothes materials in the clothes drying treatment device.

3. The temperature control method for the clothes drying treatment device according to claim 2, wherein the clothes drying treatment device is provided with a constant A and a highest value TDS of the upper limit value of the temperature interval, the upper limit value TDx of the temperature interval is smaller or equal to TDS, and TDS=TD0+A, where 0<A<TD0;

the highest value TDS of the upper limit value of the temperature interval is determined by the clothes materials in the clothes drying treatment device, and each of the clothes materials corresponds to a highest heating temperature that can be tolerated during a drying process respectively;

TDS is a minimum temperature among the highest heating temperatures that can be tolerated corresponding to the clothes materials in the clothes drying treatment device.

4. The temperature control method for the clothes drying treatment device according to claim 3, wherein the clothes drying treatment device turns off the heating device when a temperature in the clothes drying treatment device increases to the upper limit value TDx of the temperature interval at an xth time under a heating action of the heating device, and TDx and x satisfy TDx=TD0+A*K^(x−1), where 0<K<1.

5. The temperature control method for the clothes drying treatment device according to claim 1, wherein the clothes drying treatment device is provided with a system on temperature TT0, the system on temperature TT0 is a set value, and the lower limit value TTy is continuously closer to the system on temperature TT0 with the increase of the number of on times y of the heating device.

6. The temperature control method for the clothes drying treatment device according to claim 5, wherein the clothes drying treatment device is provided with a constant B and a lowest value TTS of the lower limit value of the temperature interval, the lower limit value TTy of the temperature interval is greater than or equal to the lowest value TTS, and the lowest value TTS=TT0−B, where 0<B<TT0;

the first lowest value TTS of the lower limit value of the temperature interval is determined by the liquid point temperature of the liquid in clothes in the clothes drying treatment device, and the first lowest value TTS is the liquid point temperature.

7. The temperature control method for the clothes drying treatment device according to claim 6, wherein the clothes drying treatment device turns on the heating device when the temperature in the clothes drying treatment device decreases to the lower limit value TTy of the temperature interval at the yth time after the heating device stops heating, TTy and y satisfy: TTy=TT0−B*M^(y−1), where 0<M<1.

8. The temperature control method for the clothes drying treatment device according to claim 5, wherein the system on temperature TT0 is determined by a liquid point temperature of liquid in clothes in the clothes drying treatment device, and the system on temperature TT0 is greater than the liquid point temperature.

9. A temperature control method for a clothes drying treatment device, comprising a heating device of the clothes drying treatment device executing an on or off operation in a temperature interval, when a temperature in the clothes drying treatment device reaches an upper limit value TDx of the temperature interval under an action of the heating device, the clothes drying treatment device turns off the heating device and the heating device stops heating; wherein, the upper limit value TDx of the temperature interval decreases with an increase of a number of off times x of the heating device, wherein when the temperature in the clothes drying treatment device decreases to a lower limit value TTz of the temperature interval at a zth time, the clothes drying treatment device turns on the heating device and the heating device executes heating;

the lower limit value TTz of the temperature interval decreases with the increase of a number of on times z of the heating device;

the clothes drying treatment device is provided with a system on temperature TT0, the system on temperature TT0 is a set value, and the lower limit value TTz is continuously closer to TT0 with the increase of the number of on times z of the heating device;

TT0 is determined by a liquid point temperature of liquid in clothes in the clothes drying treatment device, and TT0 is greater than the liquid point temperature;

the clothes drying treatment device is provided with a constant C and a highest value TTS of the lower limit value of the temperature interval, the lower limit value TTz of the temperature interval is not greater than the highest value TTS, and the highest value TTS=TT0+C, where 0<C<TT0;

the highest value TTS of the lower limit value of the temperature interval is determined by the liquid point temperature of the liquid on the clothes in the clothes drying treatment device, and the highest value TTS is the liquid point temperature;

the clothes drying treatment device turns on the heating device when the temperature in the clothes drying treatment device decreases to the lower limit value TTz of the temperature interval at the zth time after the heating device stops heating, TTz and z satisfy: TTz=TT0+C*NA^(z−1), where 0<N<1.

* * * * *